US006234962B1

(12) United States Patent
Williams

(10) Patent No.: US 6,234,962 B1
(45) Date of Patent: May 22, 2001

(54) EQUINE DENTAL SPECULUM

(76) Inventor: Todd R. Williams, P.O. Box 807, Turner Valley, Alberta (CA), T0L 2A0

( * ) Notice: Subject to any disclaimer, the term of this patent is extended or adjusted under 35 U.S.C. 154(b) by 0 days.

(21) Appl. No.: 09/630,588

(22) Filed: Aug. 1, 2000

(51) Int. Cl.[7] ..... A61D 15/00
(52) U.S. Cl. ..... 600/243; 600/239
(58) Field of Search ..... 600/243, 244, 600/237, 239

(56) References Cited

U.S. PATENT DOCUMENTS

| | | | | |
|---|---|---|---|---|
| 843,040 | * | 2/1907 | Seabrant | 600/243 |
| 1,331,542 | * | 2/1920 | Vose | 600/244 |
| 1,383,421 | * | 8/1921 | Forgrave | 600/239 |
| 1,915,454 | * | 6/1933 | Steigenberger | 600/243 |
| 4,450,831 | | 5/1984 | Jeffrey . | |
| 5,199,418 | | 4/1993 | Jamison et al. . | |
| 5,704,901 | * | 1/1998 | Meister | 600/243 |
| 5,718,665 | | 2/1998 | Stubbs . | |
| 5,799,617 | | 9/1998 | Long et al. . | |
| 5,842,974 | | 12/1998 | Stubbs . | |
| 5,888,064 | | 3/1999 | Stubbs . | |

FOREIGN PATENT DOCUMENTS

| | | | | |
|---|---|---|---|---|
| 613131 | * | 5/1935 | (DE) | 600/239 |

* cited by examiner

*Primary Examiner*—Paul J. Hirsch
(74) *Attorney, Agent, or Firm*—Sean W. Goodwin

(57) ABSTRACT

A one-piece equine dental speculum having an open frame, extending from one side of a horse's mouth, across in front of the incisors to the opposite side of the mouth. Bite plates are affixed at the front of the speculum to engage the incisors when the speculum is fully inserted. Two V-shaped projections extending rearward from each end of the bite plates act as wedges to engage the incisors and force them towards the upper and lower bite plates, forcing the jaws apart. Simply, insertion requires placing the speculum frame around the horse's mouth, placing the V-shaped projections between the upper and lower incisors and pushing until the incisors are "walked" along the upper and lower surfaces of the V-shaped projections to open the jaws. Once fully inserted, the incisors are held in place at the bite plates preventing the jaws from closing. Nose and head straps hold the speculum in place in the horse's mouth. The projections are narrowly spaced to further prevent the user from inserting their hands into the opened horse's mouth, lowering the risk of injury to the user.

9 Claims, 3 Drawing Sheets

EQUINE DENTAL SPECULUM

FIELD OF THE INVENTION

The present invention relates to the field of equine dentistry and more particularly to equine oral speculums.

BACKGROUND OF THE INVENTION

Equine speculums have been used for over one hundred years. Early prior art speculums engaged the molars, whereas newer forms engage the incisors. One form of equine speculum used is that described in U.S. Pat. No. 5,704,901 to Meister, generally comprise U-shaped upper and lower jaw pieces extending from one side of the horses head, around past the teeth and lips to the other side of the horses head. Plates at the front of the upper and lower jaw pieces engage the incisors. The speculum is held in the mouth by means of adjustable nose and head straps, much like a bridle. A handle or lever mechanism is attached pivotally to the speculum so as to allow the user to force the lower jaw piece to rotate respective to the upper, thereby opening the horse's mouth. A single tooth pawl located on the handle, engages one of a series of teeth on the front of the lower jaw piece to maintain the open mouthed position allowing the user full access to the mouth and cheek teeth.

Other widely used variations have ratchet assemblies at the rear of the speculum, generally one on each side, used to mechanically force the jaws apart.

In the hands of capable professionals, existing dental speculums can be used with success to perform dental procedures.

Problems occur when horse owners and trainers wish to inspect the condition of their horse's teeth, either before or after dental procedures have been performed. As the cheek teeth are obscured unless the mouth is open, a speculum must be used to view them. Existing speculums are heavy and difficult to operate. In the case of the ratcheted speculum, the device must be opened first on one side and then on the other. The speculum can be opened too far, risking damage to the apparatus, but more importantly inflicting damage to the horse's jaws. Levered or ratcheted speculums present a very real danger for trapping or catching of fingers and skin within the pawls or ratchet devices. Once in place, there is a tendency for the user to put their hands inside the horse's mouth. If installed improperly, the incisors can come sideways off the plates, at the front of the speculum, and the user can be badly bitten.

An objective of the present invention is to provide a one-piece, single position speculum that can be readily inserted by those unskilled in equine dental practices, allowing the user to easily view all of the cheek teeth. Further, it is an objective to provide a speculum that does not allow the user to place their hands inside the horse's mouth while inspecting the teeth.

SUMMARY OF THE INVENTION

An equine dental speculum for viewing a horse's teeth is provided comprising a one-piece open frame, upper and lower bite plates affixed to the front of the frame and two V-shaped projections spanning from upper to lower bite plate, one at each side of the bite plates and extending into the mouth. Once inserted, the speculum is held in place by nose and head straps, attached to the speculum.

More particularly, the front of the speculum comprises upper and lower horizontally-extending and parallel bite plates which are spaced apart for engaging top and bottom incisors and holding the jaws open at an optimal position for viewing. The bite plates are spaced apart using one or more vertical supports. A wedge, having a base and rearwardly converging upper and lower surfaces forming an apex, is joined, at the base, to the upper and lower bite plates. The wedge surfaces act to guide the incisors to their respective bite plates. A pair of attachment members extend rearwardly from the front of the speculum to enable attachment of straps for securing the speculum in the horse's mouth.

The wedge is formed of two V-shaped projections which are spaced laterally apart, but are close enough to engage the incisors. The open ends of each V-shaped projection form the base and join with the upper and lower bite plates.

Each of the two attachment members comprises a U-shaped frame which is open for viewing the cheek teeth. The two U-shaped frames are spaced laterally apart so as to fit externally on either side of the horse's mouth. The open ends of each frame member attach to the front of the speculum, preferably to the upper and lower bite plate.

Strap attachment points are positioned at the rearmost end and along the length of the attachment members for securing the speculum in the horse's mouth.

As the speculum is inserted into the horse's mouth the incisors engage the surfaces of the two V-shaped projections which act as wedges to force the incisors and the jaws apart. When fully inserted, the incisors rest against the upper and lower bite plates to hold the jaws open. Nose and head straps attached to the open frame hold the speculum in place, allowing the user to view the incisors and the cheek teeth. Preferably, the V-shaped projections, positioned at the front of the speculum, are spaced close enough so as to prevent the user from putting their hands into the horse's mouth without obscuring the view of the inner surfaces of the cheek teeth.

DETAILED DESCRIPTION OF THE PREFERRED EMBODIMENT

Figure 1:
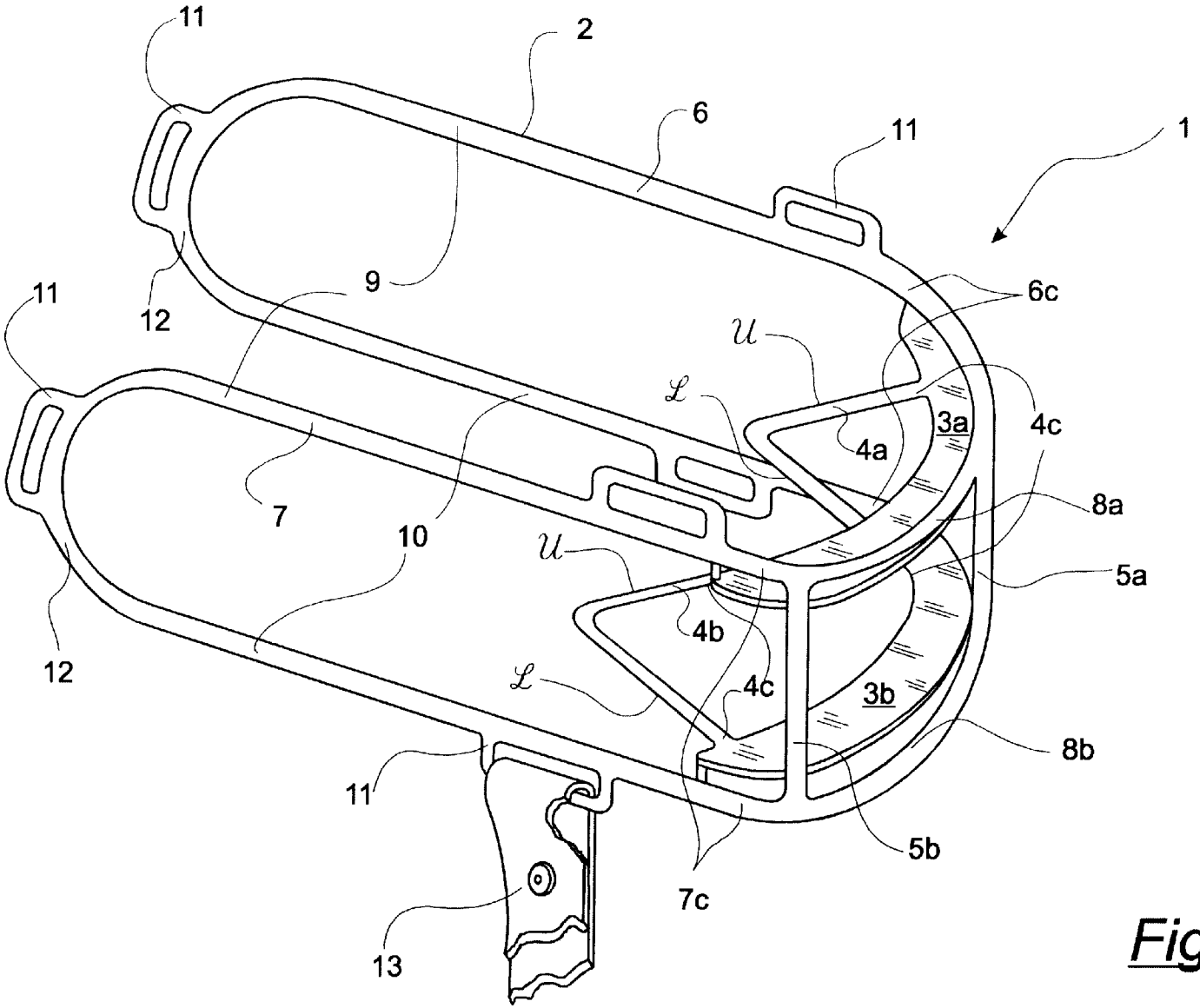
FIG. 1 is a perspective view of the equine speculum of the present invention.

Having reference to FIG. 1, a one-piece equine dental speculum 1 is provided. The speculum 1 comprises an open frame 2, upper and lower bite plates 3*a*, 3*b* to engage a horse's incisors and hold it's jaws open and two V-shaped projections 4*a*,4*b* extending rearward to the center of the speculum 1.

In a preferred embodiment of the invention, the upper and lower bite plates 3*a*,3*b* are at the front of the frame 2 or speculum 1. The bite plates 3*a*,3*b* extend horizontally in parallel arrangement. The bite plates 3*a*,3*b* are spaced by and attached to two vertical support members 5*a*,5*b* located at the front of the open frame 2.

Two V-shaped projections 4*a*,4*b*, form an upper surface U and a lower surface L which converge rearwardly from open ends 4*c*, are spaced laterally and joined to the upper and lower bite plates 3*a*,3*b* at their open ends. The projections

4*a*, 4*b* are spaced laterally sufficiently to engage the incisors and direct them along the upper and lower surfaces U,L towards the bite plates 3*a*,3*b* when the speculum 1 is inserted into the horse's mouth. Further, the projections 4*a*,4*b* are narrowly spaced so as to restrict someone using the speculum 1 from being able to put their hand into the horse's mouth, thus avoiding any biting injuries.

The speculum frame 2 also comprises two, open, U-shaped attachment members 6,7 lying in a vertical plane, each joined, at their open ends 6*c*,7*c*, to the ends of the vertical support members 5*a*,5*b* to which the bite plates 3*a*,3*b* are attached. Two curved members 8*a*,8*b* extend between the vertical support members 5*a*,5*b* to strengthen the speculum frame 2, now formed as a one piece speculum 1 having an upper U-shaped rail 9 and lower U-shaped rail 10, both rails lying parallel to each other in a horizontal plane.

Strap attachment rings 11 are formed on the upper and lower speculum frame rails 9,10 on either side of the speculum 1 for attachment of nose straps 13 (only one partially shown - FIG. 2*a*) and at the rearmost end 12 of each U-shaped frame member 6,7 for attachment of a head strap (not shown).

Figure 2A:
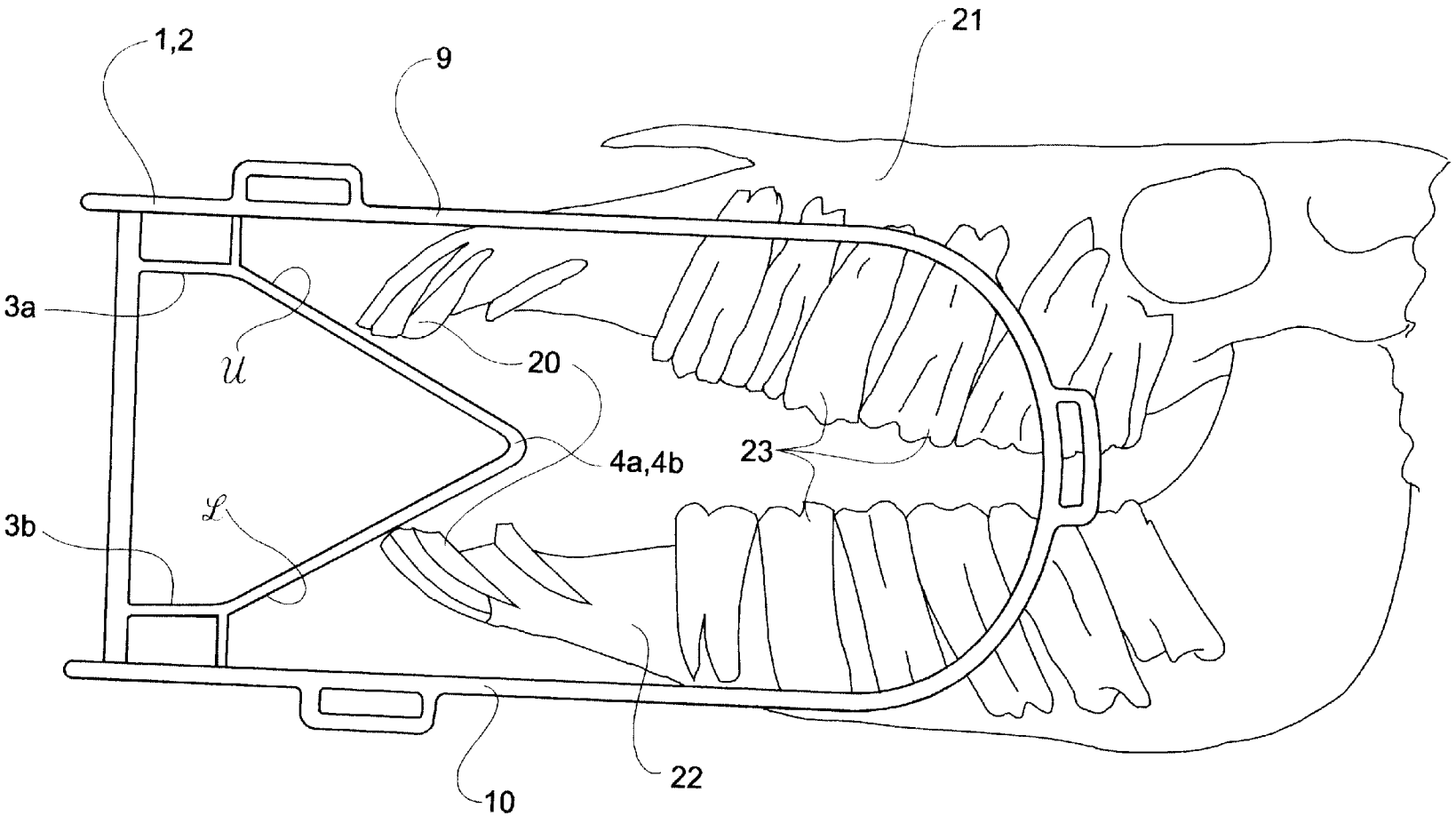
FIG. 2*a* is a side view of the skeletal structure of a horse's jawbones, illustrating the relationship of the incisors with respect to the V-shaped projections at the front of the partially inserted speculum. For clarity of the speculum structure, straps are not shown.

Having reference to FIG. 2*a*, in use, the speculum 1 is placed about the horse's mouth and inserted in much the same way as a bit is inserted. As the speculum 1 is inserted into the horse's mouth, the incisors 20 are engaged by the two V-shaped projections 4*a*,4*b* and are "walked" along the upper and lower surfaces U,L of the projections 4*a*,4*b*, causing the horse's jaws 21,22 to open.

Figure 2B:
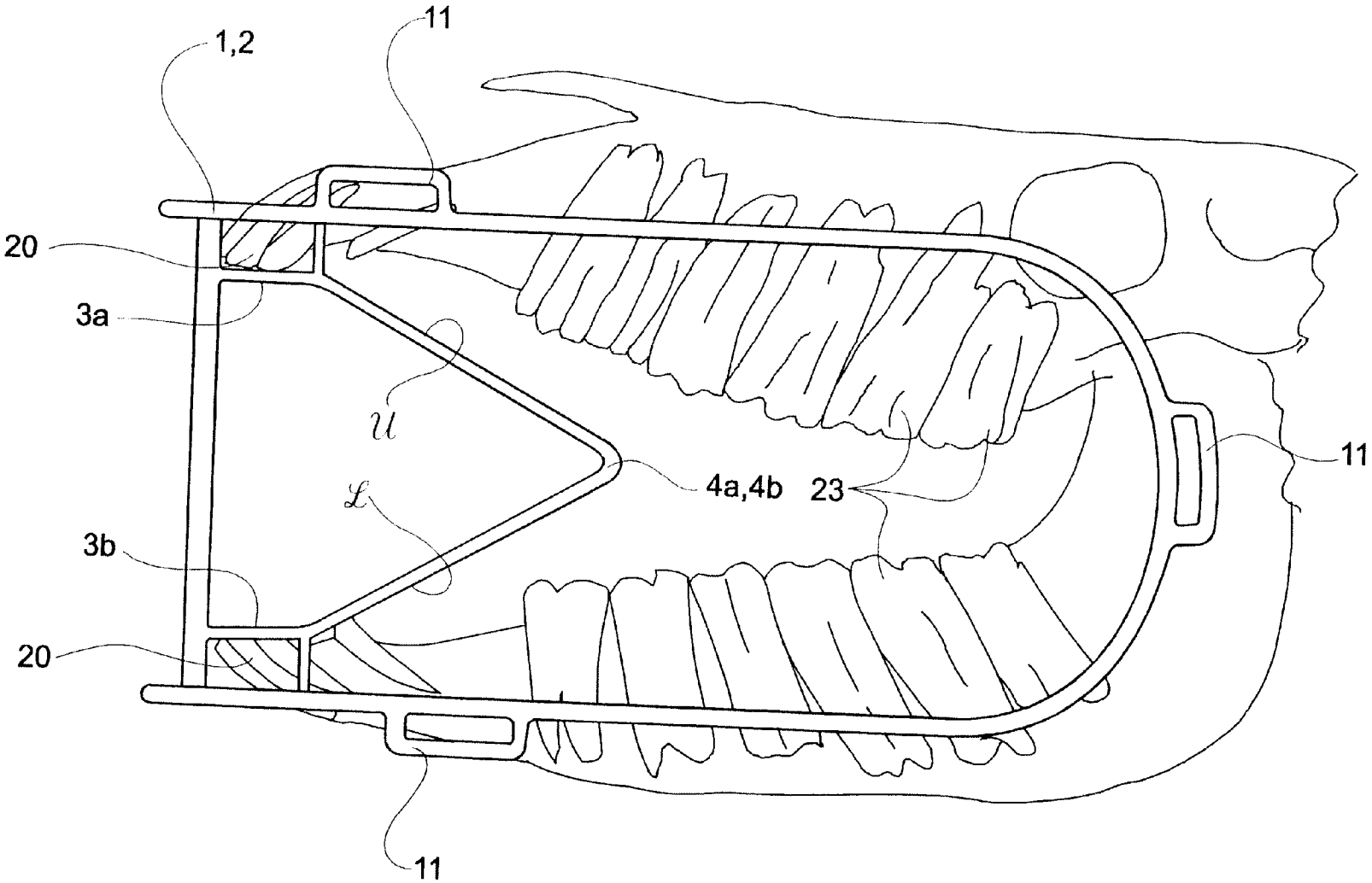
FIG. 2*b* is a side view of the skeletal structure of a horse's jawbones, illustrating the relationship of the incisors with respect to the bite plates at the front of the fully inserted speculum.

As shown in FIG. 2*b*, once the speculum 1 is fully inserted, the incisors 20 rest on the bite plates 3*a*,3*b* at the front of the speculum 1, preventing the jaws from closing.

The speculum 1 is held in place in the horse's mouth by nose straps 12 and head straps (not shown) attached to the speculum 1 by the attachment rings 11.

Fully inserted, the speculum 1 allows full view of cheek teeth 23 through the open frame 2, not readily visible without the use of a speculum, as well as acting to prevent the viewer from putting his hands in the horse's mouth and risking injury.

What is claimed is:

1. A one-piece equine dental speculum for viewing upper and lower incisors and cheek teeth within a horse's mouth, the one piece speculum comprising:

(a) two, horizontally-extending and parallel spaced bite plates at the front of the speculum for engaging the upper and lower incisors and holding the jaws open in an optimum viewing position;

(b) one or more V-shaped projections, each having surfaces converging rearwardly from an open end to an apex and which are joined to the bite plates at the open end, for acting as a wedge between the upper and lower incisors and directing the incisors to the respective bite plates; and (c) means for securing the speculum in the horse's mouth.

2. The apparatus as described in claim 1 further comprising a frame for supporting the bite plates, the attached V-shaped projections and securing means.

3. The apparatus as described in claim 2 wherein the bite plates are spaced by and joined to one or more vertically extending support members.

4. The apparatus as described in claim 3 wherein the frame for supporting the bite plates and attached V-shaped projections are rearwardly extending attachment members.

5. The apparatus as described in claim 4 wherein the rearwardly extending attachment members are open U-shaped frame members, one attached to each end of the parallel spaced bite plates.

6. The apparatus of claim 5 wherein the rearwardly extending U-shaped frame members have attachment rings formed at the apex at the rear of each U-shaped frame member and at, at least one position, along the length of each member for attachment of the securing means.

7. The apparatus as described in claim 6 wherein the means for securing the speculum in the horse's mouth are nose and head straps attached to the speculum frame at the attachment rings.

8. A method for viewing a horse's upper and lower incisors and cheek teeth comprising the steps of:

(a) providing a speculum having two bite plates for engaging the upper and lower incisors and holding the jaws open, and one or more wedges having surfaces converging rearwardly from the bite plates; and (b) inserting the wedge between the upper and lower incisors causing the incisors to engage the surfaces of the wedge and directing the incisors towards the respective upper and lower bite plates to hold the jaws open in an optimum viewing position.

9. The method as described in claim 8 wherein the wedge acts as a blocking means preventing access to the open mouth.

* * * * *